United States Patent [19]

Wakbayashi et al.

[11] Patent Number: 4,738,077

[45] Date of Patent: Apr. 19, 1988

[54] APPARATUS FOR FORMING CONTAINERS

[75] Inventors: Shigeru Wakbayashi; Tadaaki Kume; Yasuji Fujikawa, all of Tokushima, Japan

[73] Assignee: Shikoku Kakooki Co., Ltd., Tokushima, Japan

[21] Appl. No.: 886,704

[22] Filed: Jul. 18, 1986

[30] Foreign Application Priority Data

May 26, 1986 [JP] Japan ..... 61-80117[U]

[51] Int. Cl.[4] ..... B31B 3/52

[52] U.S. Cl. ..... 53/375; 493/184; 493/452

[58] Field of Search ..... 493/184, 452; 53/266 R, 53/371, 375

[56] References Cited

U.S. PATENT DOCUMENTS 3,890,765 6/1975 Farfaglia et al. ..... 493/184

4,509,312 4/1985 Nakajima ..... 53/375

*Primary Examiner*—Frederick R. Schmidt

*Assistant Examiner*—William E. Terrell

*Attorney, Agent, or Firm*—Armstrong, Nikaido, Marmelstein & Kubovcik

[57] ABSTRACT

An apparatus for folding the top closures of tubular containers of square to rectangular cross section having a bottom into the form of a gabled roof. The top closure comprises first and second pairs of opposed quadrilateral panels, and each of the first panels has fold lines. The apparatus comprises first and second folding members provided at an intermediate portion of a path of transport of the container by a conveyor, between a filling device and a top closure sealing device along the path. The first folding member inwardly folds the first pair of panels between the second pair while the container is being transported by the conveyor, whereupon the second folding member operates to inwardly fold the second pair of panels over the first pair already folded by the first folding member. The top closure is foldable into the gabled form reliably and can therefore be subsequently sealed free of any trouble.

3 Claims, 9 Drawing Sheets

APPARATUS FOR FORMING CONTAINERS

BACKGROUND OF THE INVENTION

The present invention relates to an apparatus for folding the top closures of containers of quadrilateral cross section having a bottom and filled with a fluid food or the like into the form of a gabled roof before the top closure is sealed.

The top closure of the container comprises two pairs of opposed quadrilateral panels which are connected together in the form of a tube of square to rectangular cross section. Conventionally, the top closure is folded into the form of a gabled roof in its entirety by inwardly folding only one of the two pairs of quadrilateral panels, so that the top closure, which is not folded to a full extent, is not always satisfactorily sealable in the subsequent step. This tendency becomes pronounced when the container is made of a resilient material since the folded top closure readily unfolds owing to the resiliency.

SUMMARY OF THE INVENTION

The main object of the present invention is to provide an apparatus for folding the top closures of containers effectively and fully to such an extent that the closure can be sealed free of trouble.

The present invention provides an apparatus for folding the top closuresof tubular containers of quadrilateral cross section having a bottom into the form of a gabled roof, the top closure comprising first and second pairs of opposed quadrilateral panels, each of the first quadrilateral panels having fold lines for rendering the top closure easily foldable into the gabled form. The folding apparatus comprises a first folding member and a second folding member which are provided at an intermediate portion of a path of transport of the container by a conveyor, between a filling device and a top closure sealing device arranged along the path of transport. The first folding member inwardly folds the first pair of quadrilateral panels of the top closure between the second pair of quadrilateral panels while the container is being transported by the conveyor, whereupon the second folding member operates to inwardly fold the second pair of quadrilateral panels over the first pair already folded by the first folding member. The top closure of the container is foldable into the form of a gabled roof effectively and fully and can be sealed without any trouble.

With reference to the accompanying drawings, an embodiment of the invention will be described below for illustrative purposes only.

DESCRIPTION OF THE PREFERRED EMBODIMENT

Figure 11:
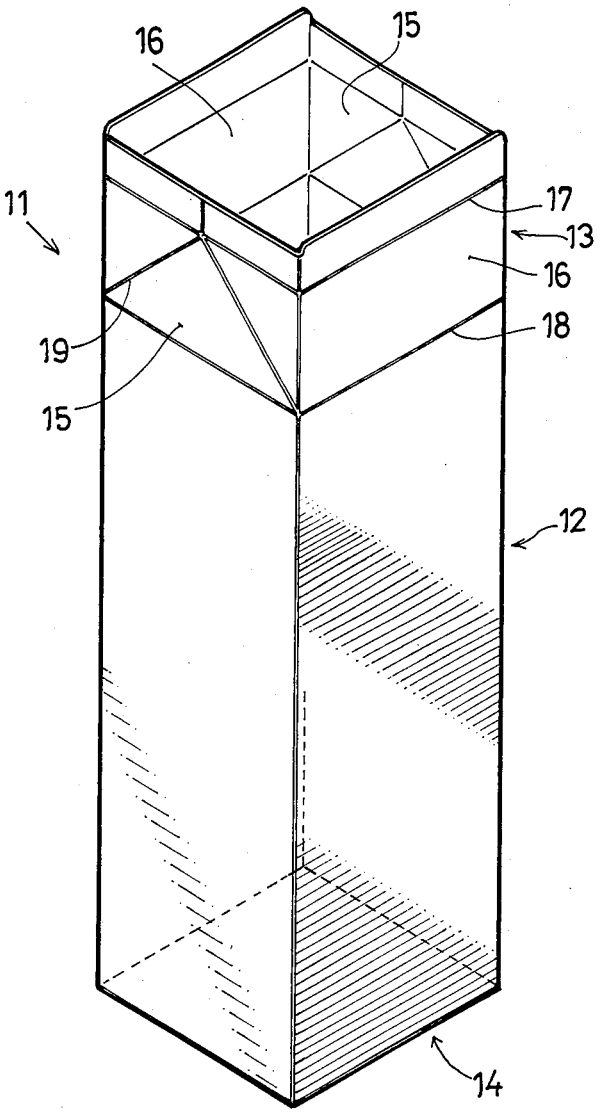
FIG. 11 is a perspective view showing a container.

The container to be folded by the present apparatus will be described first before describing the apparatus. As seen in FIG. 11, the container 11 comprises a body 12 of square cross section, and a top closure 13 and bottom closure 14 connected respectively to the upper and lower ends of the body 12. Although the material of the container 11 will not be described in detail since it has no direct relation to the present invention, the entire container 11 is formed from a single blank of laminate made chiefly of paper and has inner and outer surface layers of thermoplastic synthetic resin. Although not shown, the bottom portion of the blank is folded generally flat to provide the bottom closure 14. The top closure 13 is in the form of a square tube formed by extending the body 12 almost as it is, and comprises first and second pairs of opposed quadrilateral panels 15 and 16. The first and second quadrilateral panels 15, 16 have an upper transverse fold line 17 endlessly extending in its entirety and positioned toward their upper ends. Similarly, a lower transverse fold line 18 is formed endlessly at the boundary between the body 12 and the top closure 13. Of the first and second quadrilateral panels 15, 16, each first panel 15 has a pair of oblique fold lines 19 extending upward from its opposite ends toward each other and intersecting the upper transverse fold line 17 at the center of the panel 15.

Figure 10:
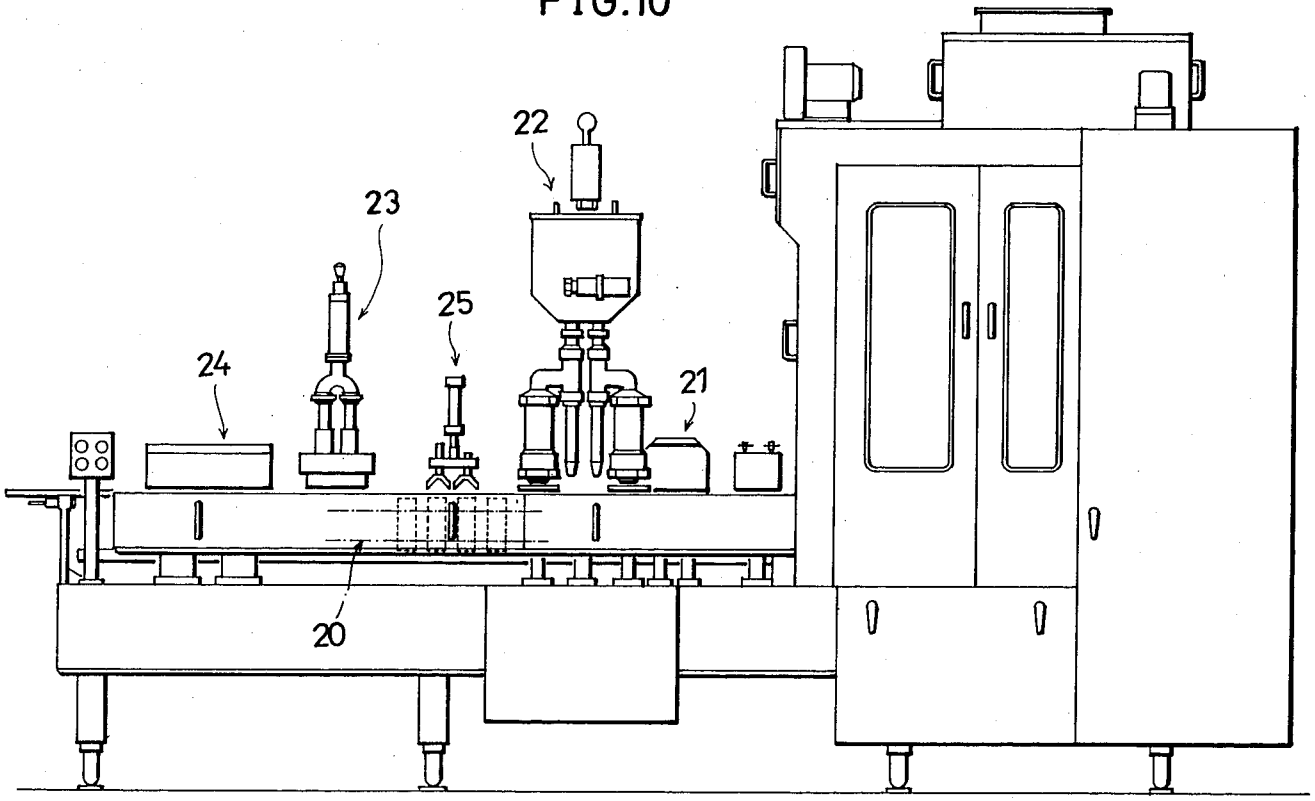
FIG. 10 is a side elevation schematically showing a packaging machine in its entirety including the apparatus of the invention.

The apparatus of the present invention is included in a packaging machine which is schematically shown in its entirety in FIG. 10 and has a conveyor 20 for transporting containers 11. A container supplying-forming apparatus (not shown) is disposed above the starting end of the path of transport of containers by the conveyor 20. By this apparatus, container blanks folded flat and each shapable into a tube of square cross section are unfolded into square tubes, and the tubes are closed each at its one end to provide containers 11 in the form of a square tube having a bottom. Provided along the path of the conveyor 20 are a device 21 for prefolding the top closures of containers, a filling device 22, a device 23 for heating the top closures of containers and a device 24 for pressing the top closures of containers, these devices being arranged in the order mentioned in the direction of transport. An apparatus 25 of the invention for folding the top closures of containers is interposed between the filling device 22 and the heating device 23. While the devices and apparatus mentioned above are adapted to perform the required packaging work for two containers at a time during transport on the conveyor, this does not relate to the primary feature of the present invention.

As suitably shown in FIGS. 1 to 6, the conveyor 20 comprises a pair of horizontal endless chains 26 arranged side by side, guides 27 therefor, and a multiplicity of holders 28 generally U-shaped when seen from above, facing outward and attached to the chains 26 as arranged at a spacing longitudinally thereof. The holders 28 on one chain 26 are opposed to those on the other chain 26 in pairs when they are almost brought into the feed path, such that the holders 28 in each pair face each other with a space formed therebetween for accommodating the container 11. The container 11 is held by the pair of holders 28 with its top closure 13 projecting above the holders 28 and with the two first quadrilateral panels 15 of the top closure 13 at right angles with the direction of transport. A guide rail 29 for supporting the bottoms of containers 11 extends under and in parallel with the feed path along which the holders 28 travel.

As shown in detail in FIGS. 1 to 9, the top closure folding apparatus 25 comprises first and second folding members 30 and 31.

The first folding member 30 has a vertically movable piece 32 in the form of a vertical flat plate and disposed above and in parallel with the path of feed travel of the holders 28. The movable piece 32 is inverted V-shaped in its entirety when seen from one side and therefore has an inverted V-shaped lower edge 33. The distance between the opposite ends of the lower edge 33 of the piece 32 is greater than the distance between the two first quadrilateral panels 15 of the top closure 13.

The second folding member 31 comprises a pair of pivotal pieces 34, 35 each in the form of a flat plate and arranged on opposite sides of the vertically movable piece 32 in opposed relation to each other. Each of the pivotal pieces 34, 35 is pivotally movable about a horizontal line parallel with the direction of travel of the holders 28. One of the pivotal pieces, 34, is divided into two segments for the ease of assembly, but when this is not considered, each of the two pivotal pieces 34, 35 is in the form of a rectangle larger than the combined size of the second quadrilateral panels 16 of two containers 11 on one side thereof. The pivotal piece has a flange 36 or 37 integrally extending outward from its lower end. When including the flange, the pivotal piece has an L-shaped cross section in its entirety.

At one side of the path of travel of the holders 28, large and small two vertical guide rods 38 and 39 are arranged in the direction of travel. Of the two guide rods 38, 39, the large rod 38 has a slidable sleeve 40 fitted therearound. The slidable sleeve 40 is integrally formed with an ear 41 projecting in the direction of travel of the holders 28 and another ear 42 projecting in the opposite direction. Connected to the former ear 41 is the piston rod 44 of a long large hydraulic cylinder 43 directed vertically downward. The upper end of the cylinder 43 is attached to a horizontal plate 45 interconnecting the upper ends of the two guide rods 38, 39. The latter ear 42 has at its free end a bifurcated portion 46 which holds the guide rod 39 by a slidable tubular guide member 47, whereby the slidable sleeve 40 is held against rotation. The slidable sleeve 40 is integral with an arm 48 projecting toward a position above the path of travel of the holders 28 forming a vertically slidable member generally inverted and U-shaped when seen from the direction of travel. The support arm 48 has a bore 49 extending through the upper midportion thereof. A short small hydraulic cylinder 50 directed vertically downward is mounted on the support arm 48 as if closing the upper end opening of the bore. Two vertically movable pieces 32 arranged in the direction of travel of the holders 28 are connected by a horizontal connecting bar 52 to the piston rod 51 of the hydraulic cylinder 50. A vertical rod 53 for guiding the movable pieces 32 upward or downward and also for retaining them against revolution extends upward from one end of the connecting bar 52. The vertical rod 53 is inserted slidably through a tubular guide member 55 held by a bifurcated ear 54 integral with the support arm 48. Two opposed bearings 58 and 59 are mounted by brackets 56 and 57 on the chain guides 27 under the support arm 48. Horizontal rods 60, 61 extending in parallel with the direction of travel of the holders are supported on the bearings 58, 59, respectively. Long and short pivotal arms 62, 63 and 64, 65 are respectively fixed to the horizontal rods 60 and 61 at their opposite ends. The pivotal arms 62 to 65 extend outward from the path of travel of the holders 28 at a right angle therewith. The long and short pivotal arms 62, 63 (64, 65) on the same side of the path are parallel with each other and have fixed thereto the outward flange 36 (37) of the pivotal piece 34 (35). A pair of connecting rods 66, 67 are connected, each at its one end, to the free ends of the two long pivotal arms 62, 64, respectively. The connecting rods 66, 67 extend upward from the free ends of the arms 62, 64 and have their upper ends connected to the lower ends of the support arm 48.

Figure 1:
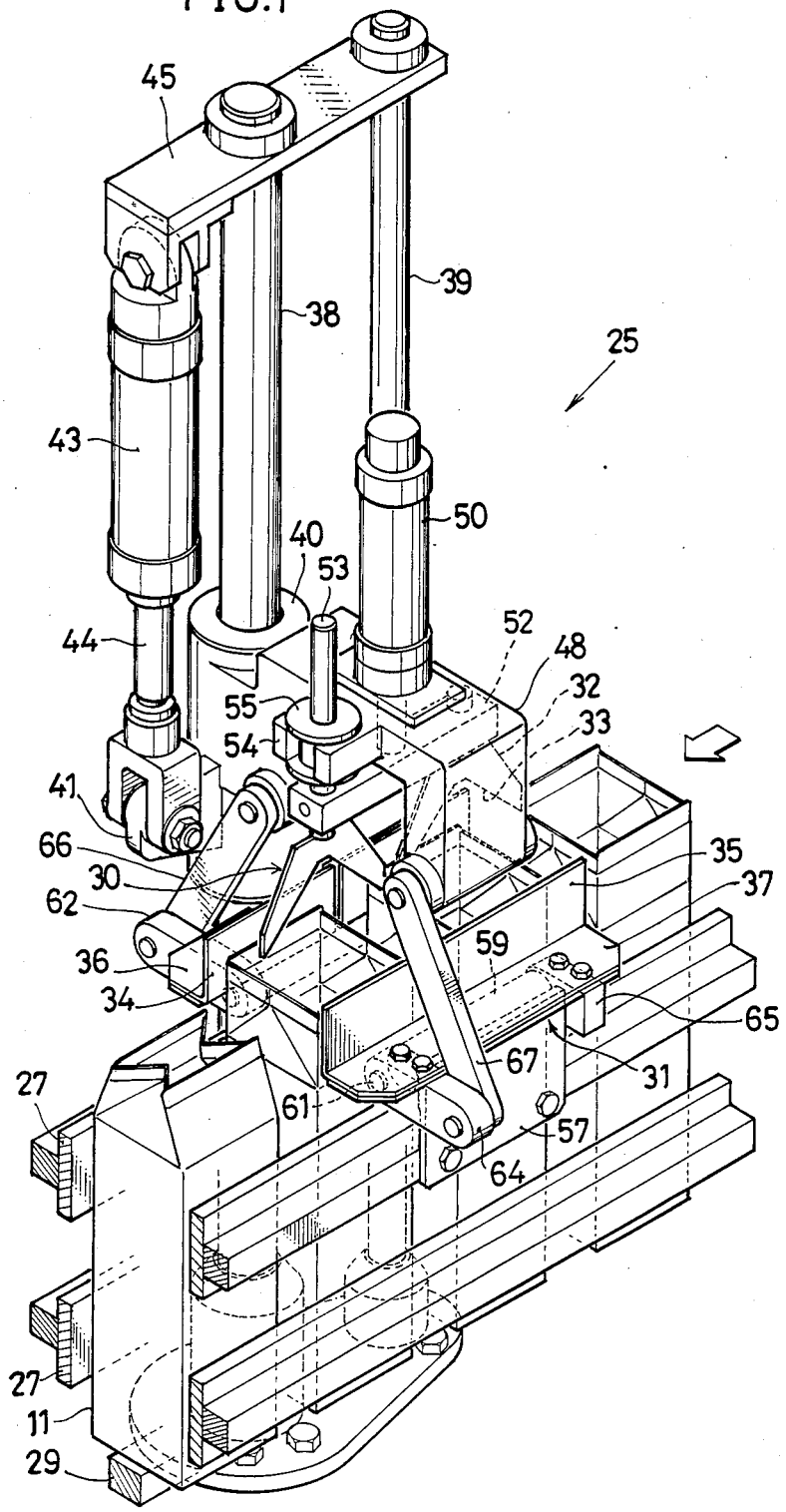
FIG. 1 is a perspective view showing an apparatus embodying the invention.
Figure 2:
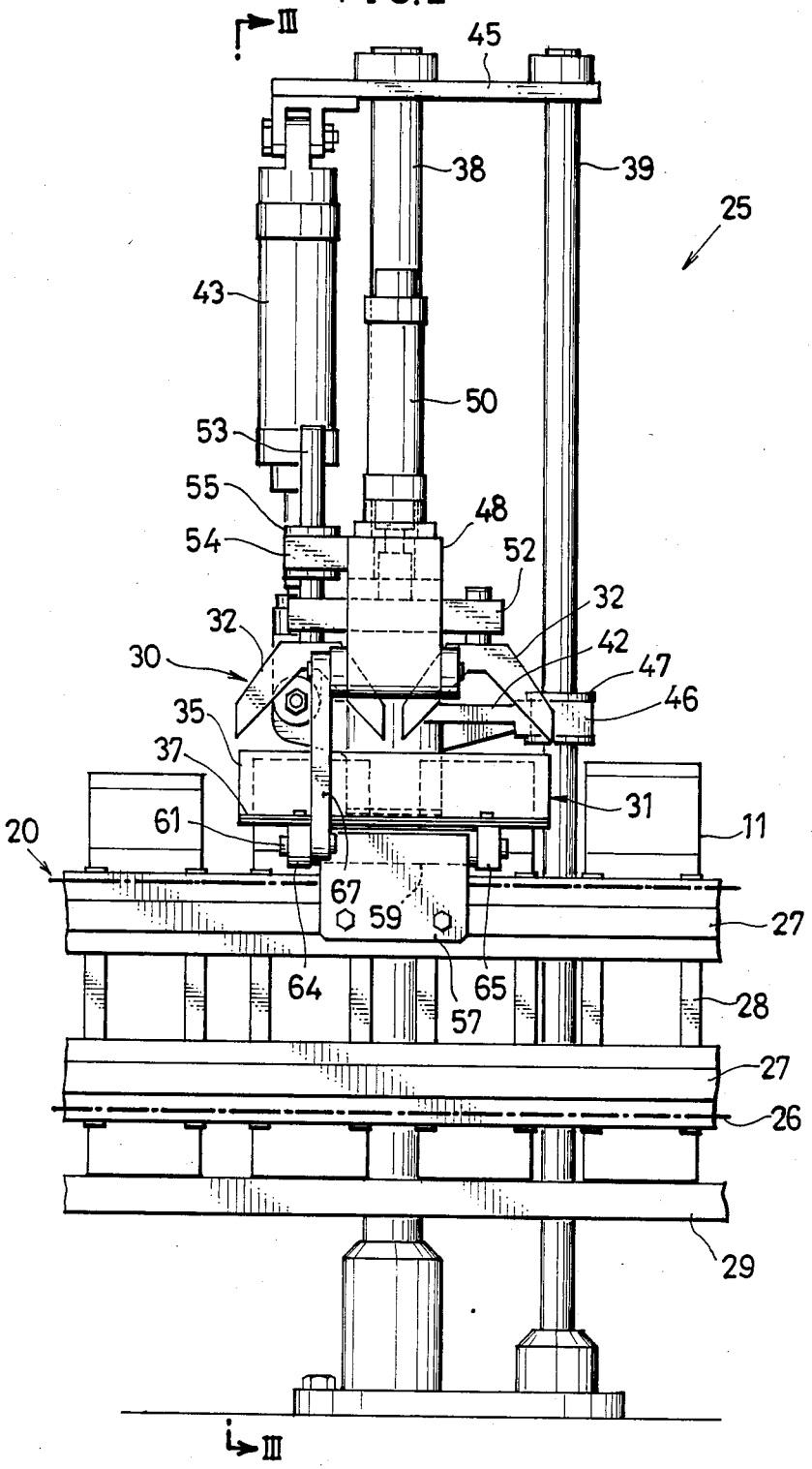
FIG. 2 is a side elevation of the same.
Figure 3:
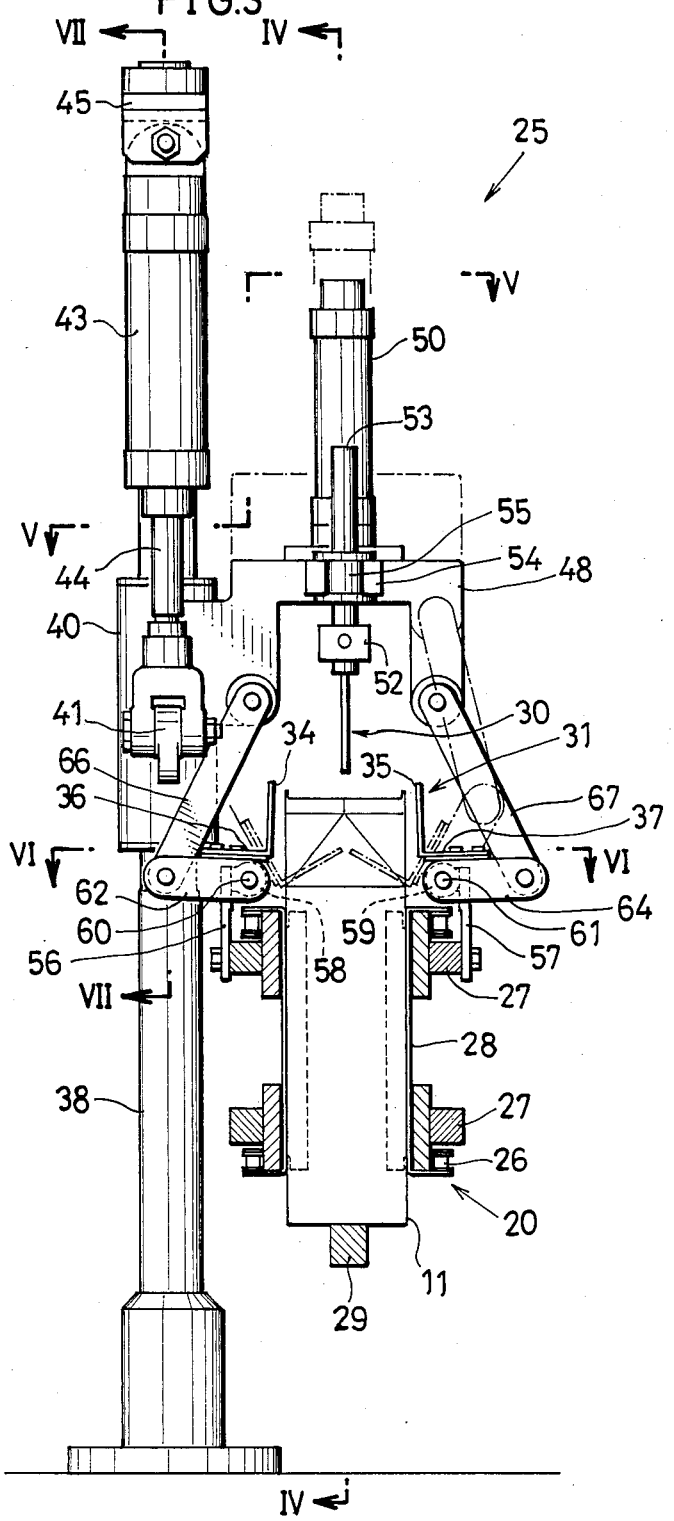
FIG. 3 is a front view of the same.
Figure 4:
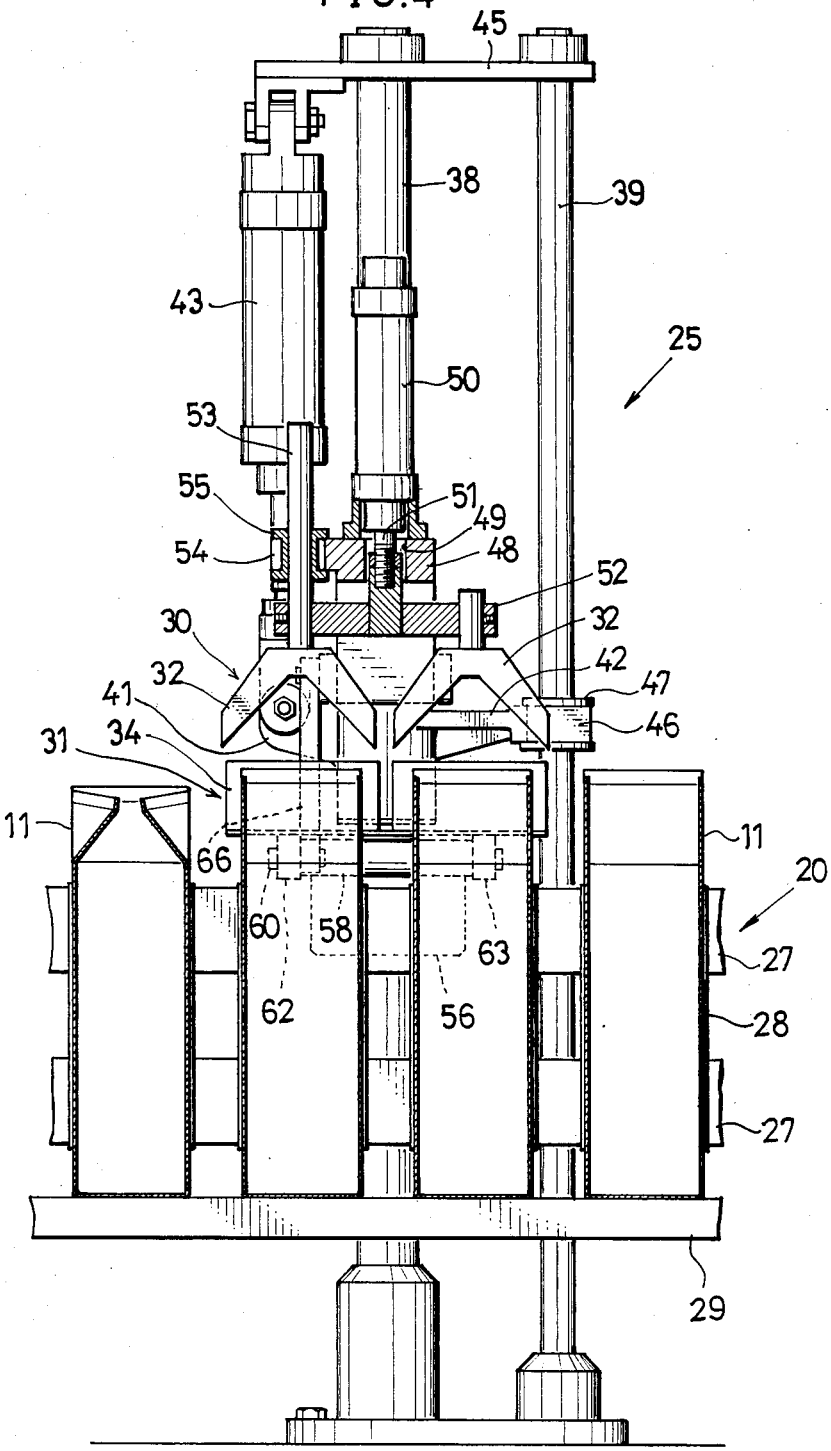
FIGS. 4 to 7 are views in section taken along the line IV—IV, line V—V, line VI—VI and line VII—VII, respectively, in FIG. 3.
Figure 5:
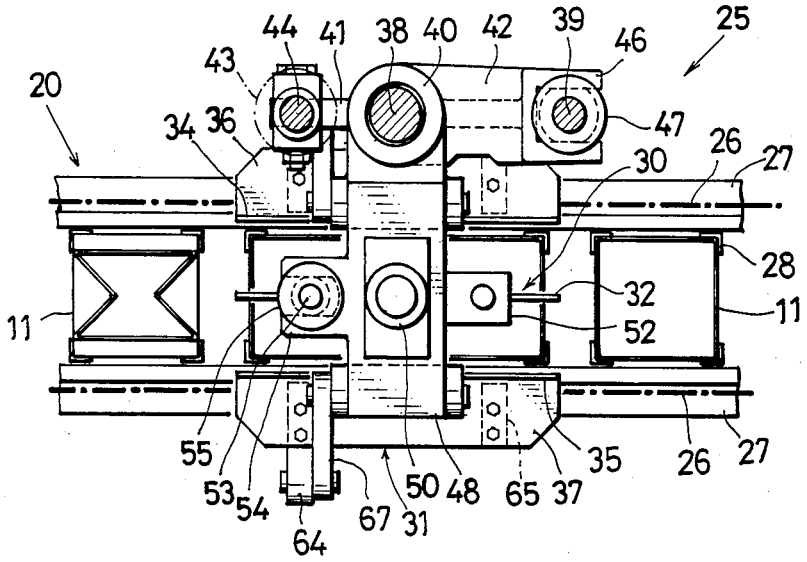
Figure 6:
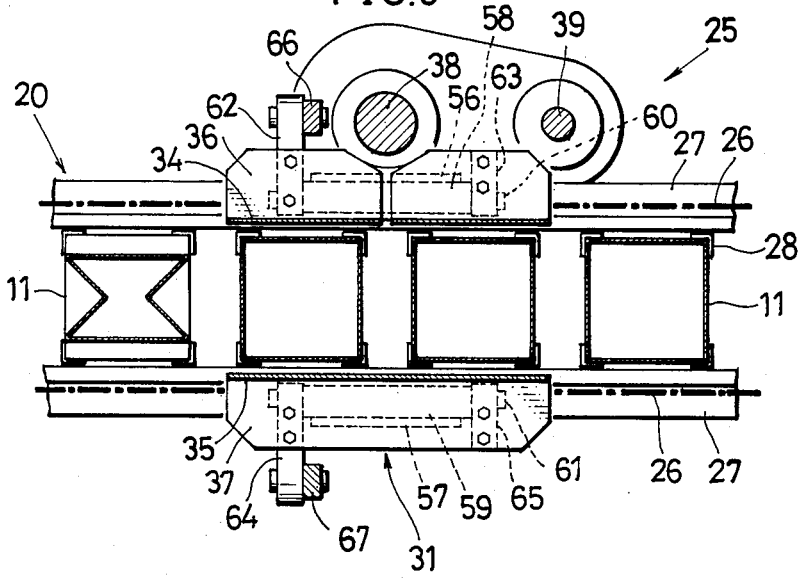
Figure 7:
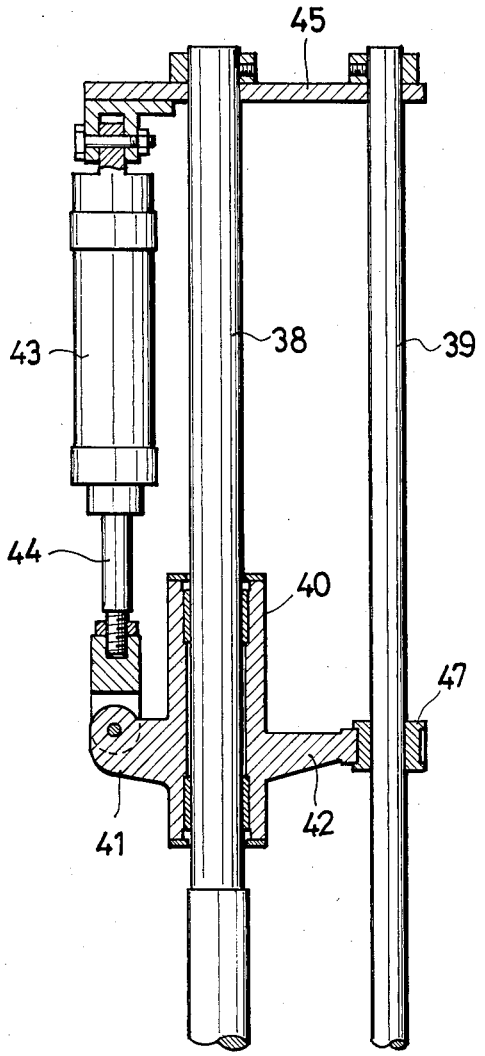
Figure 8:
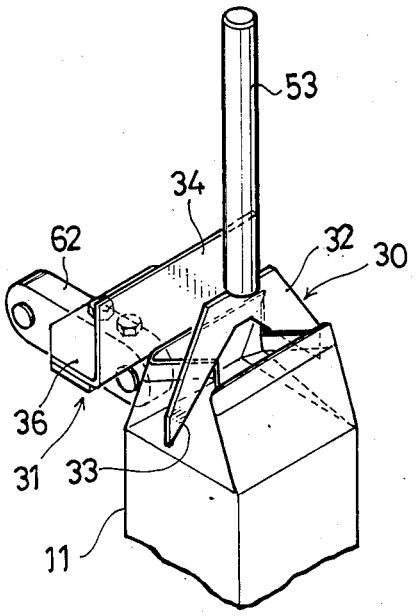
FIGS. 8 and 9 are fragmentary views illustrating folding steps.
Figure 9:
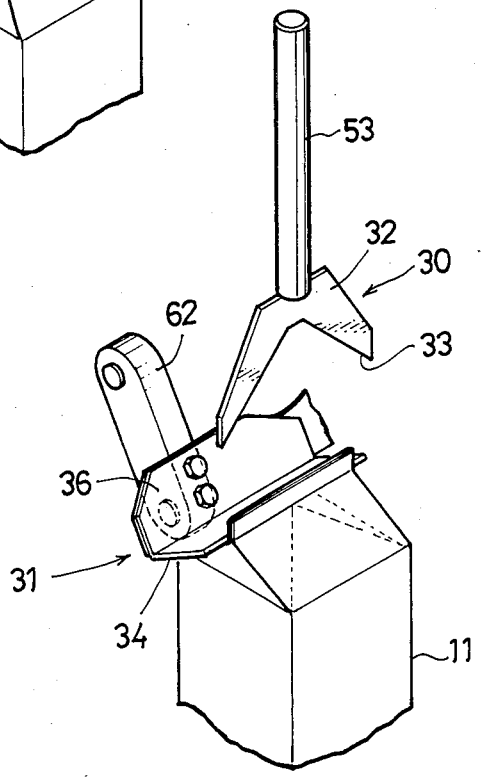

Now, it is assumed that the piston rod 44 of the large hydraulic cylinder 43 is advanced to position the slidable sleeve 40 at the lower limit of its stroke as shown in FIG. 3. The opposed pivotal pieces 34, 35 are then in an upright position. On the other hand, the piston rod 51 of the small hydraulic cylinder 50 is retracted to position the vertically movable piece 32 at the upper limit of its stroke. When the conveyor 20 is driven by one pitch in this state, the top closure 13 of a container 11 held by a pair of holders 28 is brought to the position below the movable piece 32 and between the pivotal pieces 34, 35, whereupon the small hydraulic cylinder 50 operates to advance its piston rod 51 and lower the movable piece 32 therewith. Consequently, the lower edge 33 of the piece 32 comes into contact with the upper edges of the first pair of quadrilateral panels 15 of the top closure, folding the first panels 15 inward between the second pair of quadrilateral panels 16 by pressing them obliquely inward as seen in detail in FIG. 8. The large hydraulic cylinder 43 subsequently functions to retract its piston rod 44 and raise the slidable sleeve 40 therewith. This raises the support arm 48 with the sleeve 40, causing the pair of connecting rods 66, 67 to pull up the forward ends of the long pivotal arms 62, 64, which are thereby pivotally moved toward each other, consequently moving the pivotal pieces 34, 35 in directions to bring their free ends toward each other. Thus, the pivotal pieces 34, 35 are inclined as indicated in broken lines in FIG. 3 into contact with the second pair of quadrilateral panels 16 substantially over the entire surface thereof, pressing the second panels 16 downward obliquely inward and thereby inwardly folding the second panels 16 over the two first panels 15 already folded by the movable piece 32, as seen in detail in FIG. 9. At this time, the movable piece 32 also rises with the slidable sleeve 40. This precludes the possibility of interference between the movable piece 32 and the pivotal pieces 34, 35. When the top closure 13 has been folded as described above, the large cylinder 43 functions to advance the piston rod 44 again and lower the slidable sleeve 40, moving the two long pivotal arms 62, 64 each in a direction opposite to the above and bringing the pivotal pieces 34, 35 to the initial upright position. Before this movement, on the other hand, the piston rod 51 of the small cylinder 50 retracts, holding the movable piece 32 at the upper limit of its vertical stroke. Subsequently, the conveyor 20 is driven again to send the container 11 with the folded top closure 13 to the next process and feed another container 11 with an unfolded top closure 13 to the folding position.

What is claimed is:

1. An apparatus for folding the top closures of tubular containers of quadrilateral cross section having a bottom into the form of a gabled roof, the top closure comprising first and second pairs of opposed quadrilateral panels, each of the first quadrilateral panels having fold lines for rendering the top closure easily foldable into the gabled form, the folding apparatus comprising:

first and second folding devices provided at an intermediate portion of a path of transport of the container by a conveyor, between a filing device and a top closure sealing device arranged along the path of transport, wherein the first folding device includes means for inwardly folding the first pair of quadrilateral panels of the top closure between the second pair of quadrilateral panels while the container is being transported by the conveyor, and wherein the second folding device includes means following the completion of the operation of the first folding device, and when said first folding device has moved away from the container, for inwardly folding the second pair of quadrilateral panels over the first pair of quadrilateral panels folded by the first folding device.

2. The apparatus of claim 1 wherein the conveyor has holders for holding containers each with its top closure projecting thereabove and with the first pair of quadrilateral panels positioned at right angles with respect to the direction of transport, wherein the folding means of the first folding device includes a vertically movable piece in the form of a vertical flat plate and disposed above and in parallel with the path of travel of the holders, the vertically movable piece having a lower edge of an inverted V-shape when seen from one side, the distance between opposite ends of a lower edge of the movable piece being greater than the distance between the first pair of opposed quadrilateral panels so that when the movable piece is lowered, the lower edge thereof comes into contact with the upper edge midportions of the first pair of quadrilateral panels to press the first panels downward obliquely inward, and wherein the folding means of the seocnd folding device includes a pair of pivotal pieces each in the form of a flat plate and arranged on opposite sides of the vertically movable piece to oppose each other, each of the pivotal pieces being pivotable about a horizontal line parallel with the direction of travel of the holders and being quadrilateral and larger than each second quadrilateral panel so that when the pivotal pieces pivot inwardly to bring their free ends toward one another, the pivotal pieces come into contact with the second quadrilateral panels respectively substantially over the entire surface thereof to press the second panels downwardly and obliquely inward.

3. The apparatus of claim 2 wherein said vertically movable piece is attached to the piston rod of a first hydraulic cylinder, the cylinder being directed vertically downward and mounted on a vertically slidable member, the slidable member being slidably fitted around a vertical guide rod provided at one side of the path of travel of the holders, the slidable member having connected thereto the piston rod of a second hydraulic cylinder disposed in parallel with the vertical guide rod, said pair of pivotal pieces being respectively connected to the base ends of at least one pair of pivotal arms extending in directions opposite to each other at a right angle with the direction of travel of the holders, a pair of connecting rods being connected each at its one end to the free ends of said pivotal arms respectively, the connecting rods extending upward from the free ends of the pivotal arms and having their upper ends connected to the slidable member wherein thc vertical movement of said vertically slidable member causes said second folding device to inwardly fold the second pair of quadrilateral panels over the first pair of quadrilateral panels.

* * * * *